US005913575A

United States Patent [19]

Lai

[11] Patent Number: 5,913,575

[45] Date of Patent: Jun. 22, 1999

[54] CUTTER FOR HOLLOW STRIP

[76] Inventor: Mu Tung Lai, P.O. Box 63-99, Taichung, Taiwan

[21] Appl. No.: 08/993,624

[22] Filed: Dec. 18, 1997

[51] Int. Cl.[6] ..... B26F 1/38

[52] U.S. Cl. ..... 30/229; 30/233; 30/178

[58] Field of Search ..... 30/229, 233, 258, 30/178, 296.1, 286, 289, 290

[56] References Cited

U.S. PATENT DOCUMENTS

| | | | |
|---|---|---|---|
| 2,535,383 | 12/1950 | Barnes | 30/229 |
| 2,747,278 | 5/1956 | Buyas | 30/233 |
| 2,751,681 | 6/1956 | Hillson | 30/229 |
| 4,106,195 | 8/1978 | Berg | 30/233 |
| 4,488,358 | 12/1984 | Leggett, Jr. | 30/233 |

*Primary Examiner*—Hwei-Siu Payer

[57] ABSTRACT

A cutter for cutting a hollow strip includes a pair of levers pivotally coupled together. One of the levers includes a cutter blade, and the other lever includes a jaw. The jaw includes a bracket, the bracket includes a mold piece for engaging with the interior of the strip and for stably retaining the strip in place and for allowing the strip to be cut by the cutter blade without being deformed. The bracket includes a shoulder engaged with an edge of the jaw and is secured to the jaw by a fastening bolt for allowing the bracket to be easily changed.

4 Claims, 3 Drawing Sheets

CUTTER FOR HOLLOW STRIP

BACKGROUND OF THE INVENTION

1. Field of the Invention

The present invention relates to a cutter, and more particularly to a cutter for cutting hollow strips, such as hold down strips for receiving electric wires.

2. Description of the Prior Art

Typical hollow strips, such as hold down strips, are provided for receiving and shielding the electric wires and for protecting and for preventing the electric wires from being damaged. The strips normally includes a hollow interior which may not be neatly cut by typical pliers or pipe cutters. The typical pliers or pipe cutters normally include a pair of levers having a middle portion pivotally coupled together and having a handle formed on one end and having a cutter blade formed in the other end. However, the cutter blades include a flat edge that may distort and deform the hollow strip while cutting the strip.

The present invention has arisen to mitigate and/or obviate the afore-described disadvantages of the conventional cutters for strips.

SUMMARY OF THE INVENTION

The primary objective of the present invention is to provide a cutter for neatly cutting a hollow strip without distorting or deforming the strip.

In accordance with one aspect of the invention, there is provided a cutter for cutting a strip having an interior, the cutter comprises a pair of levers including a middle portion pivotally coupled together at a pivot shaft and each including a first end having a handle and each including a second end, the second end of a first of the levers including a cutter blade, and the second end of a second of the levers including a jaw, and the jaw including a bracket, the bracket including a mold piece for engaging with the interior of the strip and for stably retaining the strip in place and for allowing the strip to be cut by the cutter blade without being deformed.

A securing means is further provided for securing the bracket to the jaw. The jaw includes an edge, the bracket includes a fin for engaging with the jaw and includes a shoulder engaged with the edge of the jaw, the securing means is provided for securing the fin to the jaw. The mold piece includes a pair of notches for engaging with a pair of hooks of the strip and for further stably retaining the strip in place. The mold piece includes at least one recess for engaging with at least one reinforcing rib of the strip and for further stably retaining the strip in place. The bracket may be easily disengaged from the jaw for replacing with a new bracket.

The bracket includes a seat, the mold piece is formed in the seat, the seat includes a pair of flaps for forming a slot between the flaps, the slot is provided for engaging with the cutter blade.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
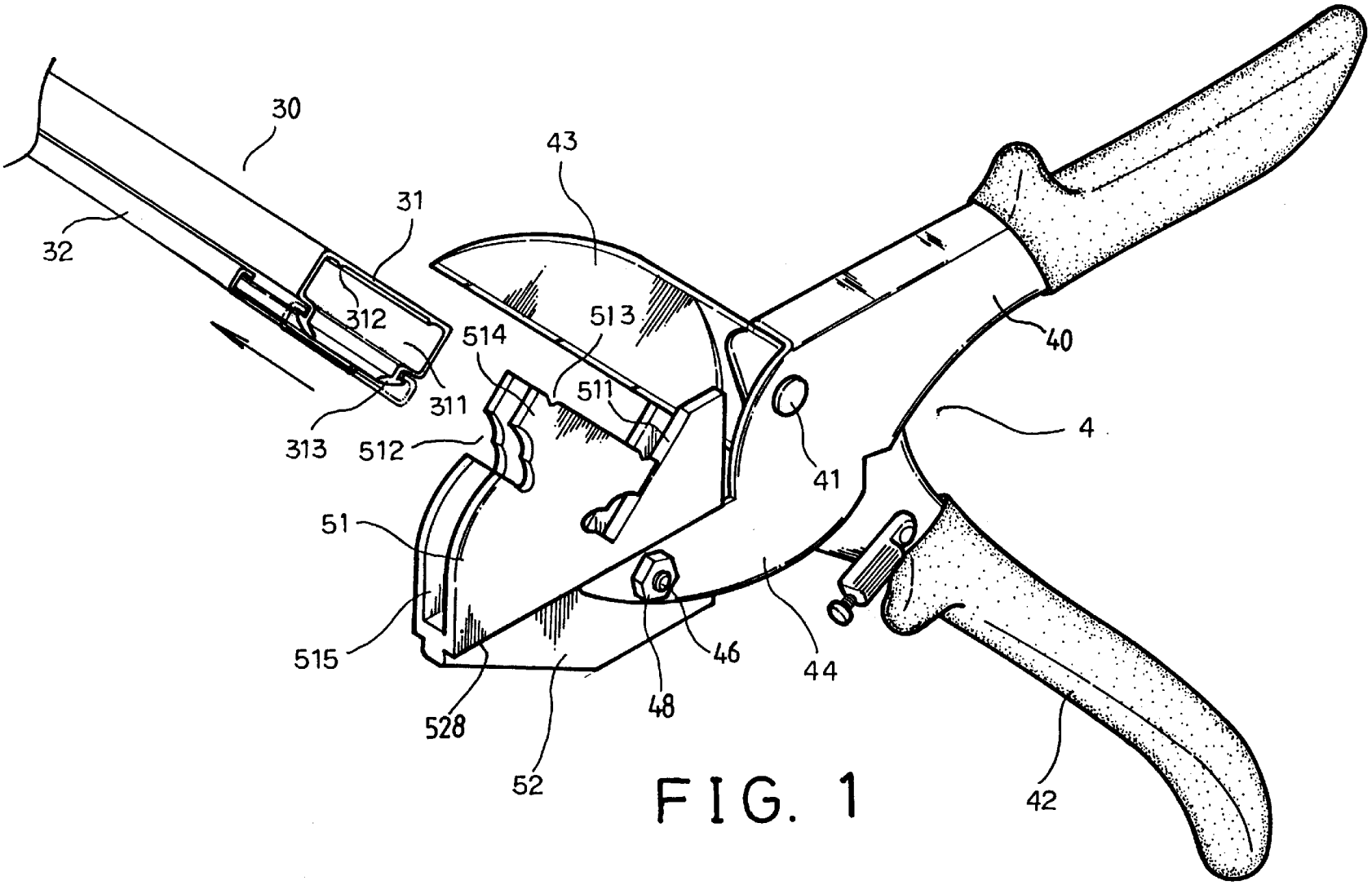
FIG. 1 is a perspective view of a cutter for hollow strip in accordance with the present invention.
Figure 2:
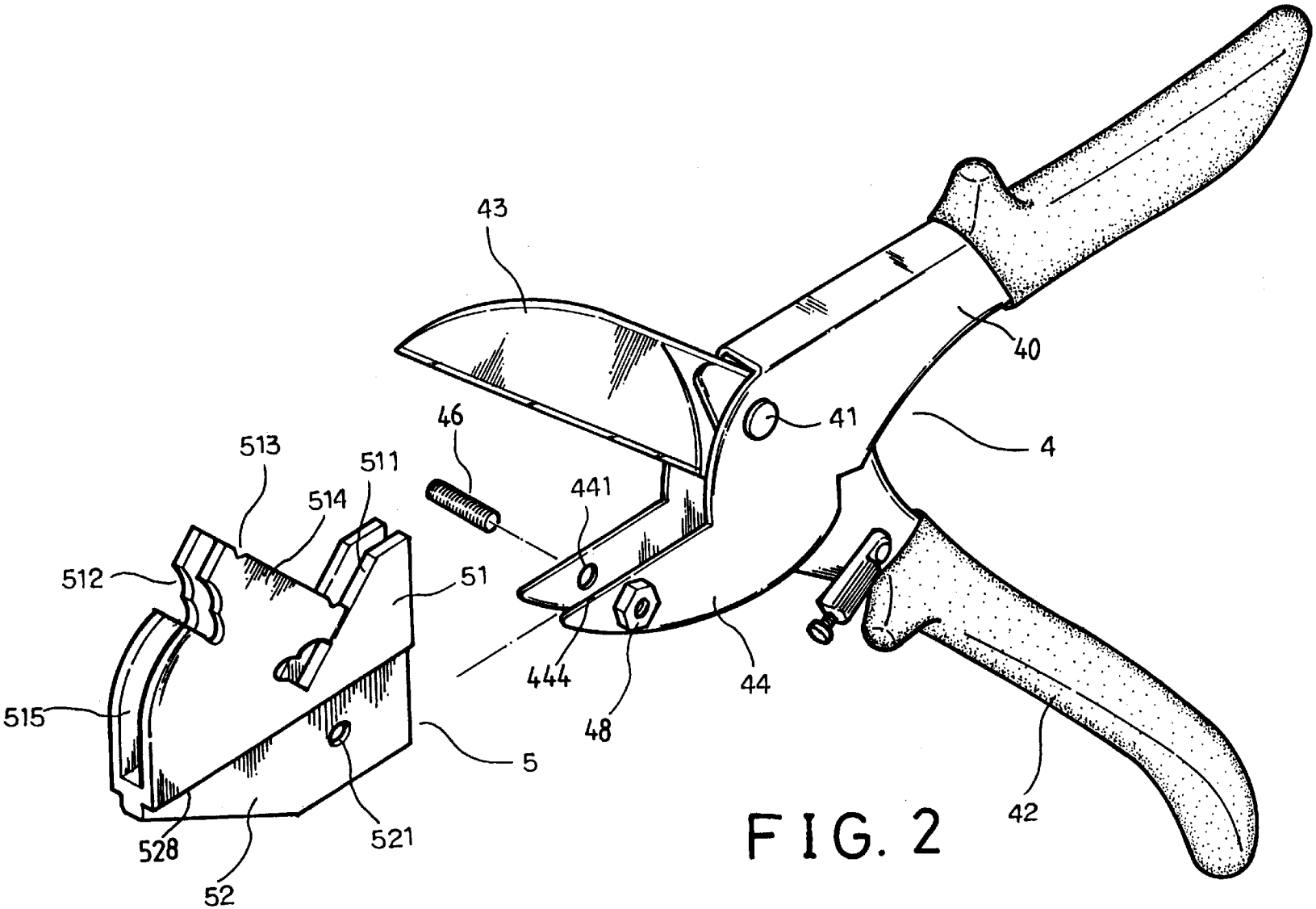
FIG. 2 is an exploded view of the cutter.
Figure 3:
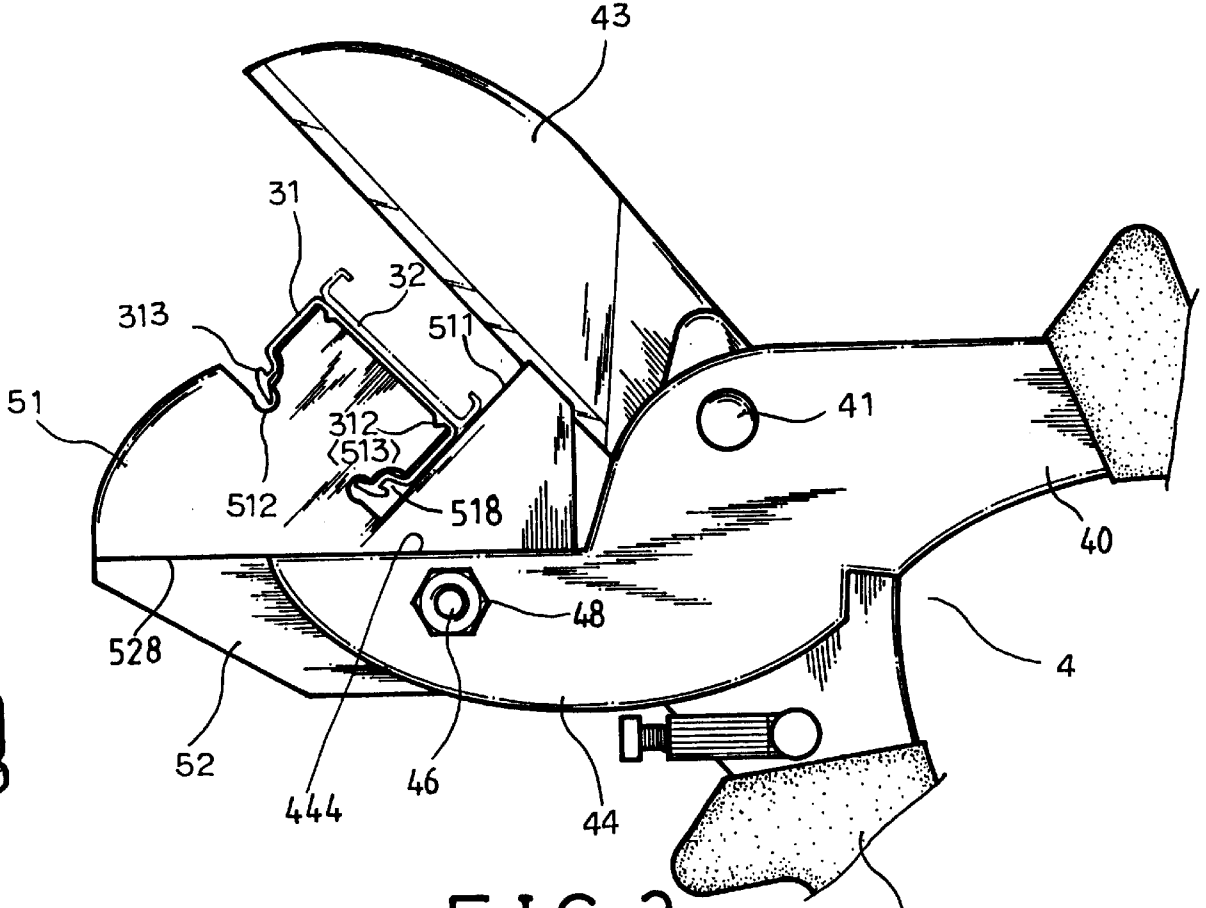
FIG. 3 is a partial plan view of the cutter.
Figure 4:
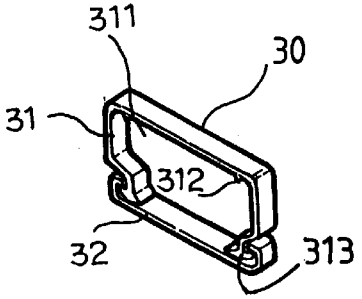
FIGS. 4 and 5 are perspective views illustrating the hollow strips to be cut by the cutter.
Figure 5:
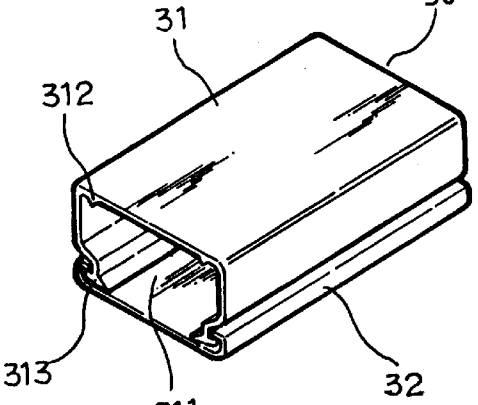

Referring to the drawings, and initially to FIGS. 1–3, a cutter in accordance with the present invention is provided for neatly cutting a hollow strip 30 (FIGS. 4, 5) and comprises a pair of levers 4 including a middle portion pivotally coupled together at a pivot shaft 41 and each including a handle 40, 42 formed on one end. One of the levers 4 includes a cutter blade 43. The other lever 4 includes a jaw 44 having a hole 441 for engaging with a bolt 46 which is engaged with a nut 48. The jaw 44 includes a flat edge 444. As shown in FIGS. 4 and 5, the strips 30 are required to be cut into different lengths from a long strip (FIG. 1). The strip 30 includes a strip member 31 having an interior 311 and for receiving an object, such as an electric wire. The legs 31 each includes a hook 313 for engaging with a cap 32 and for securing the cap 32 and the strip member 31 together. It is preferable that the strip member 30 includes one or more longitudinal ribs 312 for reinforcing purposes.

A bracket 5 includes a fin 52 and a seat 51 having a shoulder 528 formed between the fin 52 and the seat 51 for engaging with the flat edge 444 of the jaw 44. The fin 52 is engaged in the jaw 44 and has a hole 521 for engaging with the bolt 46 and for allowing the bracket 5 to be secured to the jaw 44. The seat 51 includes a mold piece 514 for engaging with the interior 311 of the strip 31 (FIGS. 3–5) and for solidly retaining the strip 31 in place. The mold piece 514 includes a pair of notches 512 for engaging with the hooks 313 (FIG. 3) and one or more recesses 513 for engaging with the ribs 312. The bracket 5 includes a pair of flaps 511 and a slot 515 formed between the flaps 511 for engaging with the cutter blade 43. A slot 518 (FIG. 3) may be formed in the bracket 5 for engaging with one side portion of the strip 31 and for stably retaining the strip 31 in place.

In operation, as shown in FIG. 3, the strip member 31 may be stably retained in place by the mold piece 514 and may be cut by the cutter blade 43 without deforming the strip member 31. The cap 32 may engage with the mold piece 514, as shown in dotted lines in FIG. 3, such that the cap 32 may also be easily and neatly cut into various lengths.

The engagement of the shoulder 528 and the edge 444 of the jaw 44 allows the bracket 5 to be easily secured to the jaw 44 with only one bolt 46. The brackets 5 of different shapes or of different sizes may thus be easily changed and secured to the jaw 44. Alternatively, the bracket 5 may also be solidly formed on the jaw 44.

Accordingly, the cutter in accordance with the present invention may be provided for neatly cutting a hollow strip without distorting or deforming the strip.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A cutter for cutting a strip having an interior, said cutter comprising:

a pair of levers including a middle portion pivotally coupled together at a pivot shaft and each including a first end having a handle and each including a second end, said second end of a first of said levers including a cutter blade, and said second end of a second of said levers including a jaw, and said jaw including a bracket, said bracket including a mold piece for engaging with the interior of the strip and for stably retaining the strip in place and for allowing the strip to be cut by said cutter blade without being deformed, and means for securing said bracket to said jaw, said jaw including an edge, said bracket including a fin for engaging with said jaw and including a shoulder engaged with said edge of said jaw, said securing means being provided for securing said fin to said jaw.

2. A cutter for cutting a strip having an interior, said cutter comprising:

a pair of levers including a middle portion pivotally coupled together at a pivot shaft and each including a first end having a handle and each including a second end, said second end of a first of said levers including a cutter blade, and said second end of a second of said levers including a jaw, and said jaw including a bracket, said bracket including a mold piece for engaging the interior of the strip and for stably retaining the strip in place and for allowing the strip to be cut by said cutter blade without being deformed, said mold piece including a pair of notches for engaging with a pair of hooks of the strip.

3. The cutter according to claim 2, wherein said bracket includes a seat, said mold piece is formed in said seat, said seat includes a pair of flaps for forming a slot between said flaps, said slot is provided for engaging with said cutter blade.

4. A cutter for cutting a strip having an interior, said cutter comprising:

a pair of levers including a middle portion pivotally coupled together at a pivot shaft and each including a first end having a handle and each including a second end, said second end of a first of said levers including a cutter blade, and said second end of a second of said levers including a jaw, and said jaw including a bracket, said bracket including a mold piece for engaging with the interior of the strip and for stably retaining the strip in place and for allowing the strip to be cut by said cutter blade without being deformed, said mold piece including at least one recess for engaging with at least one reinforcing rib of the strip.

* * * * *